US005547403A

United States Patent [19]

Haberstroh et al.

[11] Patent Number: 5,547,403

[45] Date of Patent: Aug. 20, 1996

[54] BATTERY TERMINAL CLAMP

[75] Inventors: Rudolf Haberstroh, Schonach; Georges Antonacakis, Ostfildern, both of Germany

[73] Assignee: Mercedes-Benz AG, Stuttgart, Germany

[21] Appl. No.: 405,270

[22] Filed: Mar. 15, 1995

[30] Foreign Application Priority Data

Mar. 15, 1994 [DE] Germany ..... 44 08 622.9

[51] Int. Cl.[6] ..... H01R 11/26

[52] U.S. Cl. ..... 439/763; 439/762

[58] Field of Search ..... 439/761–764, 439/770, 772, 774

[56] References Cited

U.S. PATENT DOCUMENTS

| | | | |
|---|---|---|---|
| 5,088,941 | 2/1992 | Nölle | 439/762 |
| 5,302,143 | 4/1994 | Inoue et al. | 439/762 |

FOREIGN PATENT DOCUMENTS

| | | |
|---|---|---|
| 0575181A2 | 12/1993 | European Pat. Off. . |
| 3811629C1 | 11/1988 | Germany . |
| 4138547C1 | 11/1992 | Germany . |
| 4226563C1 | 12/1993 | Germany . |
| 2268340 | 1/1994 | United Kingdom . |
| 22710228 | 3/1994 | United Kingdom . |

*Primary Examiner*—Neil Abrams

*Attorney, Agent, or Firm*—Evenson, McKeown Edwards & Lenahan

[57] ABSTRACT

A car battery terminal clamp comprises two clamping jaws which are closed on one end and can be squeezed together at opposite free ends to provide a clamping effect at a clamping receiver between the closed end and the free ends. The clamping movement is produced by a tensioning device which produces a tensioning force acting perpendicular to the plane of the clamping movement. Sloping surfaces and corresponding counter-surfaces of the free ends and/or tensioning device interact in a sliding manner, to convert the tensioning force into a clamping force perpendicular thereto. The sloping surfaces are designed in such a way that the slope angle is smaller in a region farther away from the closed end than in a region which is nearer thereto. The sloping surfaces and counter-surfaces thus maintain maximum contact in all positions during the entire clamping movement, which minimizes point-type contact pressure loading.

7 Claims, 2 Drawing Sheets

BATTERY TERMINAL CLAMP

BACKGROUND AND SUMMARY OF THE INVENTION

The invention relates to a clamp, particularly a battery terminal clamp for connecting an electric cable to a terminal of a car battery, having two clamping jaws extending generally linearly from a closed region to an open region having two free ends which are positioned opposite each other, a clamping receiver disposed between the closed end and the open end, the clamping jaws separated by a clamping gap, a tensioning device which produces a tensioning force acting perpendicular to the horizontal plane, and sloping surfaces and corresponding counter-surfaces extending away from the clamping receiver along the free ends and/or tensioning device. The sloping surfaces and counter-surfaces interact in a sliding manner to convert the tensioning force into a clamping force, moving the clamping jaws toward each other. The angle between the sloping surfaces and the horizontal plane is greater at a point near the closed end than at a point further away from the closed end.

In a car battery terminal clamp of the type shown in German Patent Specifications DE 3,811,629 C1 and DE 4,138,547 C1, the tensioning device contains a tensioning screw which is arranged parallel to the receiving direction of the battery terminal and onto which a threaded nut is screwed, which makes it possible for the tensioning device to be operated conveniently from the top of the car battery. The conversion of the tensioning force into a clamping force, running transversely to the clamping jaws is effected by means of sloping surfaces and counter-surfaces which are provided on a separate clamping piece and/or on the free ends of the clamping jaws and interact with one another in a sliding manner, the free ends of the clamping jaws being pressed towards one another when the tensioning screw is tightened. These known sloping surfaces and counter-surfaces consist in each case of flat surface sections which extend approximately radially away from the clamping receiver, i.e. perpendicular to the receiving direction of the terminal and to the direction of movement of the free ends of the clamping jaws, and are inclined perpendicular to said direction uniformly by a specific, given slope angle.

The design of the clamp with two clamping jaws which are tensioned on one side, i.e. those whose ends are fixed relative to each other in one end region while their opposite ends are movable relative to each other to produce the clamping effect, results in the clamping movement not consisting of a pure translatory movement of the clamping jaws relative to each other, but primarily of a rotary movement of the clamping jaws about a local center of rotation which generally changes its position in the course of the clamping movement. As a consequence of this rotary movement, outer regions, i.e. regions located further away from the clamping receiver, travel over a greater path during the clamping movement than regions located further inward, i.e. regions near the clamping receiver. This, in turn, means for the above-mentioned, known terminal clamps with the sloping surfaces and counter-surfaces designed in each case as flat surfaces that said surfaces only interact in a planar manner in a single position in which the sloping surfaces extend precisely parallel to one another. The more the actual position of the clamping jaws deviates in each case from this single position, the more the planar pressing contact of the sloping surface and counter-surface is lost, in particular towards the outer end edge of the jaw while the contact pressure towards the inner region near the clamping receiver increases. This results in a transition from a planar contact pressure to a linear and finally point-contact pressure, which entails a correspondingly high material stress when generating the clamping effect. The displacement of the force acting in the direction towards the local center of rotation additionally has the effect of increasing the force due to the laws of leverage and thus of stressing the material. The high point-type force loading means a restriction in the use of comparatively soft materials, such as lead-coated brass.

Reference is made in German Patent Specification DE 4,226,563 C1 to the problem of a contact surface between the sloping surfaces and the counter-surfaces being reduced during the clamping movement by tightening the tensioning device. To maintain an improved contact between the sloping surfaces and the counter-surfaces and thus a greater area to absorb the clamping force, a terminal clamp of the generic type for a battery or accumulator pole is proposed in that publication, in which the sloping surfaces on the clamping jaws are curved in such a way that their height lines lying in planes parallel to the plane of the clamping movement extend along arcs of the same curvature, the counter-surfaces provided on a clamping piece being formed to be curved in a complementary manner. The sloping surfaces therefore form parts of the outer surface of a cutting cylinder and have, at each point on their course curved parallel to the clamping plane, a constant angle between the surface horizontal and the direction perpendicular to the clamping plane and thus a slope angle of equal size at each point.

The object of the present invention is to provide a battery terminal clamp which can be produced with relatively little outlay and in which the interacting sloping sliding surfaces maintain maximum contact so that the contact pressure remains as low as possible in any clamping position.

This object has been achieved according to the present invention by providing at least one sloping surface designed such that its slope is greater at the level of an inner cutting plane near the clamping receiver than at the level of an opposite, outer cutting plane farther away from the clamping receiver. This solution takes account, in a fitting manner, of the fact that the outer regions of the free ends of the clamping jaws undergo a greater change in distance during the clamping operation than their inner regions, in such a way that, during the entire clamping operation, i.e. in any clamping position, the sloping surface and the counter-surface remain in contact at the level of the outer plane. This already provides an improvement compared to the above-mentioned known arrangement based on aspects of the laws of leverage since, according to the invention, in the worst case an only point-type contact of the sloping surface and counter-surface can result at the level of the outer plane, which already results in a lesser point-type contact pressure than in the case of a point-type contact at the level of the inner plane. Additionally, however, due to the selection of the greater slope angle according to the invention for the inner region of the surface of section, the contact between the sloping surfaces and counter-surfaces normally remains intact in all clamping positions even in that region. The resulting two-point contact has the effect of further reducing the force loading. Depending on the further individual design of the sloping surface and counter-surface interacting therewith, the contact pressure can be reduced further where a linear or planar contact of the sloping surface and counter-surface resting against one another over their entire surface, or at least along the inner and outer regions, remains intact in any clamping position. In this case, a complex shaping of curved surface sections is not absolutely essential.

In one preferred embodiment of the present invention, continuations and slot openings are located at a different level in relation to the clamping receiver and interact tangentially to the clamping receiver with respective boundary sides. The boundary sides are preferably formed as flat surface sections, the two inner, interacting sections both being designed to be inclined by the greater slope angle and the two outer sections both being designed to be inclined by the smaller slope angle. This design allows, for example, an integral design of the clamp, apart from the tensioning screws and associated threaded nuts, by suitable modification of appropriate, known clamps mentioned above.

In an alternative design of the present invention, a separate, U-shaped clamping piece is provided wherein the free ends of the clamping jaws can be squeezed together, the inner sides of the limbs providing the sloping surfaces with which counter-surfaces formed at the ends of the clamping jaws interact in a sliding manner. In a further development of this design, the sloping surfaces on the inner sides of the limbs are composed of two flat triangular surfaces which are tilted towards each other. This design of the sloping surfaces, on the one hand, can be implemented without great technical complexity and, on the other hand, constitutes a good compromise with respect to an ideal design of the sloping surfaces whose course corresponds to a square surface which is twisted in the longitudinal direction of the clamping component.

Other objects, advantages and novel features of the present invention will become apparent from the following detailed description of the invention when considered in conjunction with the accompanying drawings.

DETAILED DESCRIPTION OF THE DRAWINGS

Figure 1:
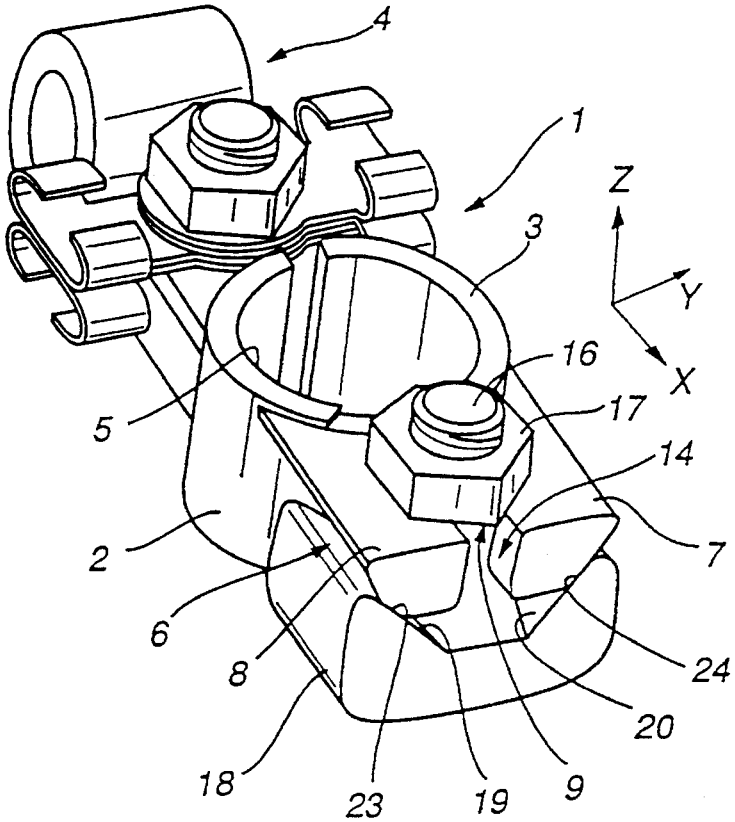
FIG. 1 shows a perspective view of a car battery terminal clamp having a tensioning device with a U-shaped clamping piece.
Figure 2:
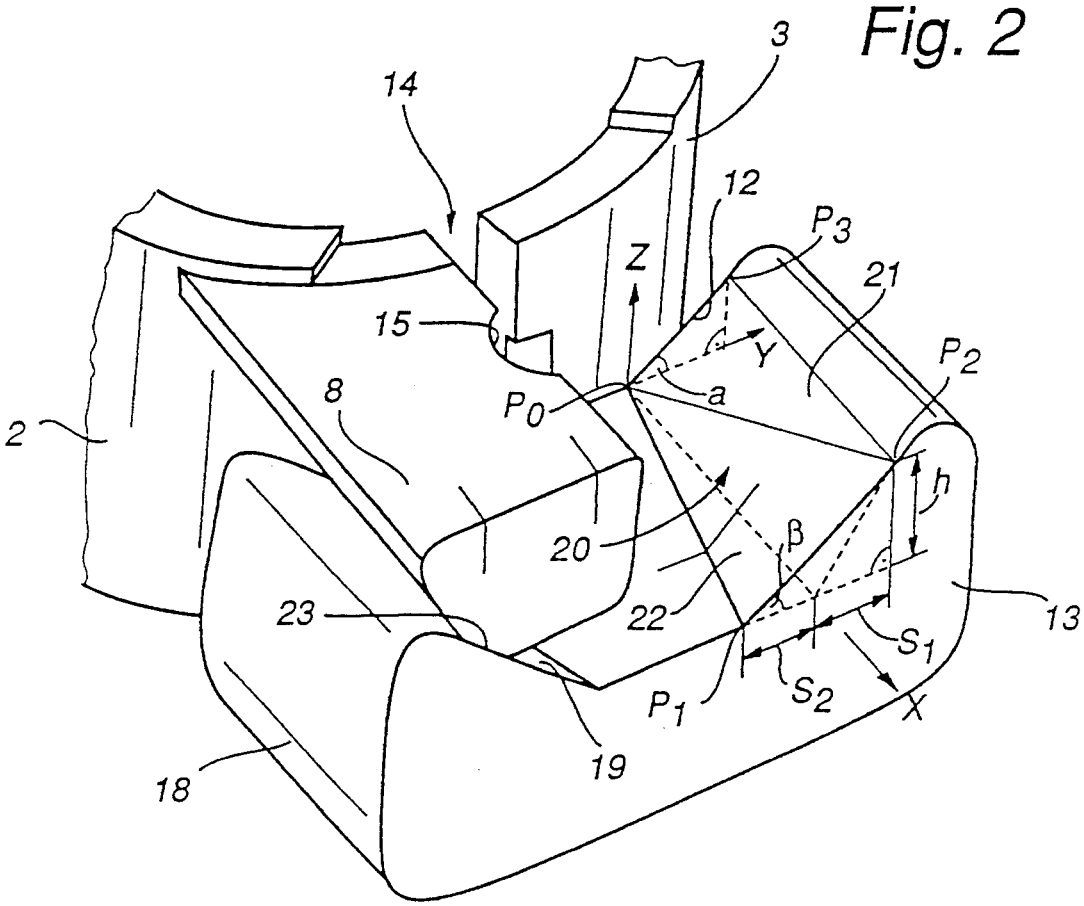
FIG. 2 shows a partial perspective view of the terminal clamp of FIG. 1 in the region of the clamping piece, omitting one free end of the clamping jaw.

A car battery terminal clamp 1, for connecting an electric cable to the terminal of a car battery is illustrated in FIGS. 1 and 2, an orthogonal coordinate system having x-, y- and z-coordinates, as shown in the figures, being selected to facilitate the further description, to which system reference is made below. The terminal clamp 1 has two clamping jaws 2, 3 which extend in the longitudinal direction, i.e. in the x-direction, from a closed end region 4, where the clamping jaws 2, 3 cannot be moved towards each other, up to an open end region 6, a cylindrical clamping receiver 5 being formed between them by a semi-cylindrical design of the clamping jaws 2, 3 in each case, into which clamping receiver the terminal of a car battery can be introduced in the z-direction. The free ends 7, 8 of the clamping jaws of the open end region 6, like the two semi-cylindrical clamping-jaw sections for the clamping receiver 5, are located opposite each other in the y-direction, separated by a continuous clamping gap 14. The clamping effect for a battery terminal which has been introduced into the clamping receiver 5 results due to the squeezing of the free ends 7, 8 of the clamping jaws while narrowing the clamping gap 14. The clamping movement thus produced corresponds essentially to a rotary movement of the clamping jaws 2, 3, which are fixed on one side, about an axis of rotation which runs in the z-direction and whose position varies in the course of the clamping operation, as a function of the precise dimensioning of the clamp 1 and of the battery terminal received, specifically generally in such a way that the axis of rotation moves away from the closed end region 4 along the longitudinal mid-axis of the terminal clamp 1, i.e along the x-direction, while the clamping jaws 2, 3 are being clamped further together.

The squeezing of the free ends 7, 8 of the clamping jaws is effected by a tensioning device 9 which contains a U-shaped clamping piece 18, which engages with its sides partially around the free ends 7, 8 of the clamping jaws in the y-direction, and a tensioning screw 16 which is fixed on the clamping piece 18 and is introduced from below through a passage opening 15 which can be seen partially in FIG. 2 and passes through the free ends 7, 8 of the clamping jaws, a threaded nut 17 being screwed from above onto the tensioning screw 16. The inner surfaces 19, 20 of the sides of the clamping piece 18 form sloping surfaces whose special design will be described in detail below, and which interact with respective counter-surfaces 23, 24 which are formed at the free ends 7, 8 of the clamping jaws in a lower region which is an outer region in the y-direction. By tightening the nut 17 on the tensioning screw, a tensioning force acting in the z-direction is consequently produced, which drives the free ends 7, 8 of the clamping jaws into the space between the two sides of the clamping piece 18. During this process, the counter-surfaces 23, 24 slide along the sloping surfaces 19, 20 formed on the inner surfaces of the sides of the clamping piece 18. As a result, the free ends 7, 8 of the clamping jaws are squeezed together in the y-direction, and the clamping jaws 2, 3 carry out the said clamping movement which provides a clamping force perpendicular to the z-direction.

As has been said, the clamping movement of the clamping jaws 2, 3 perpendicular to the z-direction does not consist of a pure translatory movement in the y-direction due to the clamping jaws being fixed on one side, but of a more complex movement which, in particular, contains a respective local rotary component about an axis of rotation running in the z-direction, such that, during the clamping movement, the different regions of the free ends 7, 8 of the clamping jaws travel over a greater clamping path with an increasing distance from the clamping receiver 5. In order, in this case, to minimize the point-type pressure loading of the sloping surface 19, 20 and the counter-surface 23, 24 resting against it in a simple manner in terms of design, the two sloping surfaces 19, 20 are designed in a specific manner, as can be seen from FIG. 2 for the one sloping surface 20. The design of the opposite sloping surface 19 is symmetrical about the vertical longitudinal center-plane of the clamping piece 18. To give a clearer picture of the design of the sloping surface 20, the associated free end 7 of the clamping jaw has been cut away in FIG. 2.

The sloping surface 20 is bounded in the x-direction towards the clamping receiver 5 by a line (P0, P3) which runs between two end points (P0, P3) and lies in an inner yz-plane 12 which is defined in this direction by the end of the clamping piece 18. On the opposite side, the sloping surface 20 is bounded by an outer line (P1, P2) which runs between two further boundary points (P1, P2) and lies correspondingly in an outer yz-plane 13 defined by the associated opposite end of the clamping piece. As further illustrated in FIG. 2, the two boundary points (P2, P3) located at the top have the same y- and z-coordinates s1 and h, such that their connecting line forms an upper boundary line of the sloping surface 20 parallel to the x-axis. In contrast, the lower boundary line which extends between the two lower boundary points (P0, P1) and forms the bending line between the clamping-piece side region and the clamping-piece middle region is tilted out of the x-direction into the y-direction in such a way that the boundary point P1 located in the outer yz-plane 13 is located nearer by a value s2 to the vertical longitudinal center-plane than the other lower boundary point P0 which is located in the inner yz-plane 12. The resulting slope angle (a) , by which the inner boundary line (P0, P3) runs at an inclination, is greater than the slope angle (β), by which the opposite outer boundary line (P1, P2) is inclined. In a specific example (in a random length unit), there are selected sl=s2=3.5 and h=6, as result of which a=60° and β=40.6°. In this case, the sloping surface 20 is composed of two flat triangular surfaces 21, 22 of which one 21 is fixed by the inner (P0, P3) and the upper (P2, P3) boundary line and the other 22 is fixed by the outer (P1, P2) and the lower (P0, P1) boundary line. As can be seen, the diagonal between the inner, lower boundary point P0 and the outer, upper boundary point P2 as a common side of the two triangular surfaces 21, 22 forms a bending line along which the two flat triangular surfaces 21, 22 abut each other at an angle of less than 180°. These flat triangular surfaces 21, 22 can be shaped with little technical complexity so that, in a simple manner, a sloping surface 20 is thus provided, whose slope angle (β) at the level of its outer edge facing away from the clamping receiver 5 is less than its slope angle (a) at the level of its inner edge facing the clamping receiver 5.

The counter-surfaces 23, 24, interacting with the sloping surfaces 19, 20, at the free ends 7, 8 of the clamping jaws are formed as flat, sloping surface sections extending in the x-direction, as is the case in the analogous, conventional terminal clamp of the prior art mentioned above, and which requires minimum design expenditure. The design of the sloping surfaces 19, 20 results in the counter-surfaces 23,24 resting against said sloping surfaces, at least both along the inner boundary line (P0, P3) and along the outer boundary line (P1, P2), in any position of the clamping jaws 2, 3. The fact that, during the clamping movement, the outer end regions of the free ends 7, 8 of the clamping jaws travel over a further path in the y-direction due to the rotary-movement component than the regions located further inward and facing the clamping receiver 5 is taken into account by the design of the outer boundary line (P1, P2) with a smaller slope angle (β) compared to the slope angle (a) of the inner boundary line (P0, P3). Specifically, with a given tensioning effect and thus a given relative movement of the clamping piece 18 and the free ends 7, 8 of the clamping jaws in the z-direction, the outer end regions of the clamping jaws slide further towards each other in the y-direction along the lesser sloping outer boundary line (P1, P2) than the inner regions of the free ends 7, 8 of the clamping jaws sliding along the inner boundary line (P0, P3).

This ensures that in any case the surfaces always rest against one another, at least with point-contact, at the level of the outer clamping-piece end 13, which, due to the longer lever arm, already means a reduction in the pressure loading compared to the point-type loading occurring in the analogous conventional terminal clamp at the level of the inner clamping-piece end 12. Additionally, the pitch (a) of the inner boundary line (P0, P3) is selected such that, there too, the counter-surface 23,24 and the sloping surface 19, 20 are at least in point-contact at least for a large majority of the possible clamping positions, thus resulting in a two-point support which further reduces the loading. Moreover, the slope angles (a, β) can be designed such that, in a significant range of clamping positions, there is a linear or strip-like contact between the sloping surface 19, 20 and the counter-surface 23, 24 both along the inner (P0, P3) and along the outer boundary line (P1, P2), which further reduces the point-type pressure loading. Additionally, although in theory at most the respective linear contact between the sloping surfaces and counter-surfaces along the inner (P0, P3) and along the outer boundary line (P1, P2) results with the assumption of ideally rigid parts for this design of the sloping surfaces and counter-surfaces, it should be taken into consideration, however, that the deviation of the sloping surface 20 provided by the two flat triangular surfaces 21, 22 from a theoretically ideal sloping surface in the form of a surface running twisted evenly between these two boundary lines is not very large. In practice, due to the resilience of the material, a noticeably flat contact of the sloping surface and counter-surface resting against one another already results due to this constructionally simple surface design, said contact surface being considerably larger than for the analogous conventional terminal clamp.

As can be seen, the terminal clamp 1 described is simple to produce in terms of design and is reliable in the provision of the clamping force using sloping surfaces which interact in a sliding manner and between which only comparatively small pressure loads occur. Further reductions in the pressure loading can be achieved by a further optimized design of the sloping surfaces and counter-surfaces. For example, provision can be made for the counter-surfaces likewise to be formed with a slope angle which varies in the x-direction, in particular in such a way that the slope angle of the counter-surfaces corresponds respectively to that of the opposite sloping surface at the level of the inner and outer clamping-piece ends. Finally, the sloping surfaces and, furthermore, if appropriate additionally the counter-surfaces can be designed, in a more complex manner, as twisted surfaces which contain no bending lines and whose angle of pitch decreases evenly from the greatest value at the level of the inner clamping-piece end down to the smallest value at the level of the outer clamping-piece end, which leads ultimately to the surfaces resting against one another over their entire surfaces to a large extent in any clamping position and thus to the least possible point-type contact pressure loading.

Figure 3:
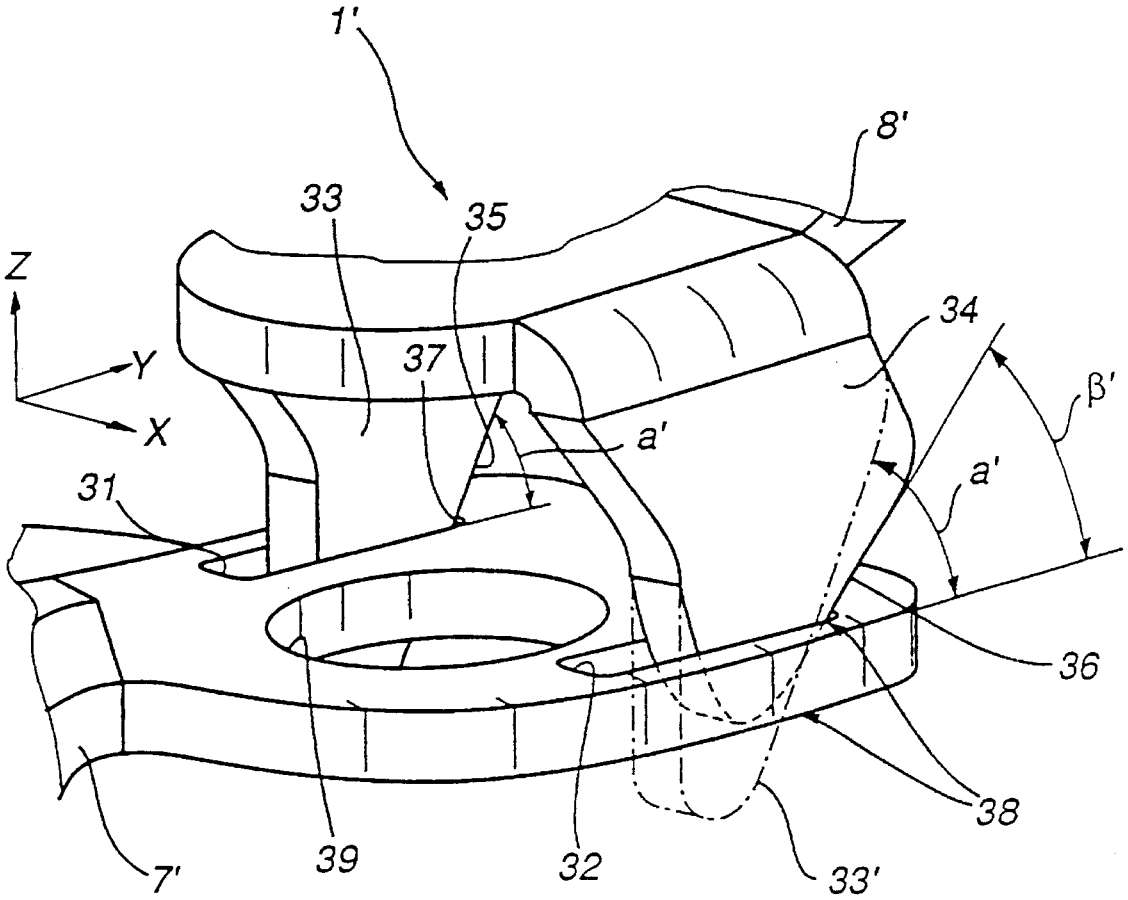
FIG. 3 shows an extract perspective view of a further car battery terminal clamp without a separate clamping piece.

The terminal clamp shown in FIG. 3 corresponds, apart from the design of the sloping surfaces and counter-surfaces described below, to a terminal clamp known from the German Patent Specification DE 4,138,547 C1 mentioned above. The clamping jaws of this terminal clamp 1' are bent from a flat punched part, thus forming a clamping receiver (not shown), and only the interacting free ends 7', 8' of the clamping jaws are shown in their terminating region in FIG. 3. For improved orientation, again an orthogonal coordinate system has been drawn, whose directions correspond to those of FIGS. 1 and 2. The one free end 7' of the clamping jaw terminates in the form of a flat area which extends in the xy-plane and has, offset in the x-direction, two slot openings 31, 32, which extend in the y-direction and are open in the z-direction, and a passage opening 39, located between them, for a tensioning screw (not shown). At the lateral termination of the other free end 8' of the clamping jaw, bent continuations or tabs 33, 34 are provided, corresponding to the two slot openings 31,32, which run in the z-direction with equal x-spacing and engage in a wedge-like manner in the slot openings 31, 32.

The tightening of a nut on the tensioning screw (not shown) causes the continuations or tabs 33, 34 to be pressed further into the slot openings 31, 32. Since the two free ends 7', 8' of the clamping jaws stretch away from one another in the y-direction per se, the rear narrow sides 35, 36 of the continuations 33, 34 facing away from the other end 7' of the clamping jaw rest against those narrow-side boundary sides 37, 38 of the two slot openings 31, 32 which face the free end 8' of the clamping jaw bearing the continuations 33,34. The rear boundary sides 35, 36 of the continuations 33, 34 thus form a sloping surface, and the associated boundary sides 37, 38 of the slot openings 31, 32 thus form the counter-surfaces interacting therewith. The sliding of the sloping surface 35, 36 and counter-surface 37, 38 against one another during the insertion movement of the continuations 33, 34 into the slot openings 31, 32 causes the free ends 7', 8' of the clamping jaws to move towards one another in the y-direction, i.e. in the circumferential direction of the clamping receiver surrounded by the clamping jaws, such that the clamping receiver is narrowed and the clamping effect thus occurs. The interaction of the continuations 33, 34 with the slot openings 31, 32 thus corresponds to the interaction of the sloping surfaces 19, 20 with the counter-surfaces 23, 24 of the terminal clamp of FIGS. 1 and 2, which surfaces rest against one another in a strip-like manner, mainly at the level of two different yz-planes.

The sloping-surface region 35 on the inner continuation 33 is designed to run obliquely at a slope angle (a'), as is the counter-surface region 37, interacting therewith, on the inner slot opening 31. In contrast, the sloping-surface region 36 on the outer continuation 34 runs at a smaller slope angle (β'), the course of an outer continuation being indicated by dot-dashed lines for comparison purposes, such as would result with a design of the outer continuation symmetrical to the inner continuation in accordance with the analogous conventional terminal clamp. The reduction of the slope angle (β') for the outer sloping surface 36 again takes into consideration in an optimum manner the fact that, during the clamping movement in which the free ends 7', 8' of the clamping jaws are moved towards each other in the y-direction while narrowing the clamping receiver located between them due to enforced introduction of the continuations 33, 34 into the slot openings 31, 32 as a result of the pair of sloping surfaces and counter-surfaces sliding against one another, the outer continuation 34 has to travel over a longer path in the y-direction than the inner continuation 33. Although, in the example of FIG. 3, the counter-surface region 38 of the outer slot opening 32 has the greater slope angle (a') of the inner counter-surface 37 for the purpose of simplicity of design, the outer sloping-surface region 36 is in any case in contact with the counter-surface 38 in the upper region thereof, such that at least a theoretically linear, in practice strip-like, resting of the outer sloping-surface region 36 against the outer counter-surface region 38 is guaranteed. This substantially improves the point-type pressure loading compared to the analogous conventional terminal clamp, in which, in the course of the clamping movement of the terminal clamp, the outer sloping-surface region is generally completely released from its corresponding counter-surface region and there is only a resting of the inner sloping-surface and counter-surface region against one another which is already unfavorable from the aspect of the laws of leverage.

By designing the outer counter-surface region 38 likewise with the smaller slope angle (β'), with an only slight increase in the design complexity, a resting of the sloping surface and counter-surface against one another over the entire area in the inner and outer region can be achieved during the entire clamping movement, which keeps the point-type contact pressure loading as low as possible, even for this type of terminal clamp.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A battery terminal clamp, comprising:

a clamping receiver having a first and a second clamping jaw which extend in a substantially x-direction from a closed end portion to an open end portion having a first free end and a second free end positioned opposite each other in a y-direction perpendicular to the x-direction, separated from each other by a clamping gap, and movable relative to each other at least in the y-direction;

a tensioning device arranged proximate the open end portion configured to produce a tensioning force which acts in a z-direction perpendicular to an x-y plane defined by the x-direction and the y-direction; and means for converting the tensioning force into a clamping force which moves the free ends toward each other essentially in the y-direction comprising at least one sloping surface extending obliquely to the x-y plane and at least one counter-surface corresponding to the at least one sloping surface, the at least one sloping surface and the corresponding at least one counter-surface slidingly configured to interact with each other;

wherein an angle between the at least one sloping surface and the x-y plane is greater at a point nearer the closed end than at a point farther away from the closed end.

2. A battery terminal clamp according to claim 1, wherein the at least one sloping surface comprises the second free end, and the corresponding at least one counter-surface comprises the first free end.

3. A battery terminal clamp according to claim 1, wherein the at least one sloping surface comprises the tensioning device, and the corresponding at least one counter-surface comprises the free ends.

4. A battery terminal clamp, comprising:

a clamping receiver having a first and a second clamping jaw which extend in a substantially x-direction from a closed end portion to an open end portion having a first free end and a second free end positioned opposite each other in a y-direction perpendicular to the x-direction, separated from each other by a clamping gap, and movable relative to each other at least in the y-direction; and a tensioning device arranged proximate the open end portion configured to produce a tensioning force which acts in a z-direction perpendicular to an x-y plane defined by the x-direction and the y-direction;

wherein the first free end comprises an inner slot and an outer slot which are open in the z-direction, the inner slot positioned nearer than the outer slot to the closed end, and the second free end comprises an inner tab and an outer tab corresponding to the inner and the outer slots, the inner tab extending in the z-direction at an inner angle obliquely to the x-y plane, the outer tab extending in the z-direction at an outer angle which is less than the inner angle obliquely to the x-y plane, the inner and the outer tabs slidably engaging in the inner and the outer slots to convert the tensioning force into a clamping force which moves the free ends toward each other essentially in the y-direction.

5. A terminal clamp according to claim 4, wherein the inner tab comprises a flat inner tab surface and the inner slot comprises a flat inner slot surface corresponding to the flat inner tab surface, the flat inner tab surface and the flat inner slot surface extending at the inner angle obliquely to the x-y plane; and wherein the outer tab comprises a flat outer tab surface and the outer slot comprises a flat outer slot surface corresponding to the flat outer tab surface, the flat outer tab surface and the flat outer slot surface extending at the outer angle obliquely to the x-y plane.

6. A battery terminal clamp, comprising:

a clamping receiver having a first and a second clamping jaw which extend in a substantially x-direction from a closed end portion to an open end portion having a first free end and a second free end positioned opposite each other in a y-direction perpendicular to the x-direction, separated from each other by a continuous clamping gap, and movable relative to each other at least in the y-direction, at least one of the free ends having at least one counter-surface extending obliquely to an x-y plane defined by the x-direction and the y-direction; and a tensioning device arranged proximate the open end portion configured to produce a tensioning force which acts in a z-direction perpendicular to the x-y plane and comprising a clamping piece of substantially U-shape in cross-section having a base parallel to the x-y plane and two sides extending from the base in the z-direction and substantially parallel to the y-direction, an inner surface of each side forming at least one sloping surface extending obliquely to the x-y plane and corresponding to the at least one counter-surface, the inner surface defined by an inner boundary line along an inner edge nearer the closed end and by an outer boundary line along an outer edge further from the closed end, the inner boundary line inclined at a greater angle with the x-y plane than the outer boundary line, the at least one sloping surface and the corresponding at least one counter-surface slidingly configured to interact with each other to convert the tensioning force into a clamping force which moves the free ends toward each other essentially in the y-direction.

7. A terminal clamp according to claim 6, wherein the at least one sloping surface comprises a first and a second flat triangular surface;

the first flat triangular surface defined by an upper edge of a first side of the clamping piece, the inner boundary line, and a line connecting a first point at the intersection of the inner boundary line with the base to a second point at the intersection of the outer boundary line with the upper edge;

the second flat triangular surface defined by the line connecting the first point to the second point, the outer boundary line, and a line connecting a third point at the intersection of the outer boundary line with the base to the first point.

* * * * *